United States Patent [19]

McCool et al.

[11] Patent Number: 4,949,402

[45] Date of Patent: Aug. 21, 1990

[54] MINI-SHIRT

[76] Inventors: Charles F. McCool, Two Rivers La., Chesapeake City, Md. 21915; Sandra M. Pagel, 4356-D Belair Ct., Andrews AFB, Md. 20335

[21] Appl. No.: 320,595

[22] Filed: Mar. 8, 1989

[51] Int. Cl.[5] ..... A41B 7/06

[52] U.S. Cl. ..... 2/124; 2/DIG. 6

[58] Field of Search ..... 2/103, 124, 60, 90, 2/123, 244, DIG. 6, 125, 126, 269

[56] References Cited

U.S. PATENT DOCUMENTS

| | | | |
|---|---|---|---|
| 2,083,712 | 6/1937 | Brio | 2/103 |
| 3,099,013 | 7/1963 | Thorpe | 2/103 |
| 3,155,985 | 11/1964 | Gallagher | 2/103 |
| 3,158,872 | 12/1964 | Pantzke | 2/103 |
| 3,230,547 | 1/1966 | Moran | 2/103 |
| 3,423,764 | 1/1969 | Cassling | 2/DIG. 6 |
| 3,555,568 | 1/1971 | Humphrey | 2/124 |
| 4,543,670 | 10/1985 | Ehring | 2/124 |
| 4,833,732 | 5/1989 | Harmsen | '/103 |

FOREIGN PATENT DOCUMENTS

| | | | |
|---|---|---|---|
| 108843 | 11/1939 | Australia | 2/124 |
| 915924 | 6/1954 | Fed. Rep. of Germany | 2/103 |
| 2323342 | 9/1975 | France | 2/124 |
| 11231 | 5/1911 | United Kingdom | 2/124 |
| 1268156 | 3/1972 | United Kingdom | 2/124 |

*Primary Examiner*—Werner H. Schroeder
*Assistant Examiner*—Diana L. Biefeld
*Attorney, Agent, or Firm*—Beveridge, DeGrandi & Weilacher

[57] ABSTRACT

A clothing assembly which features, in combination, a dickey with a collar, a sweater and a pair of cuffs releasably attachable directly to the inside of the sweater sleeves. The combination of the dickey, cuffs and sweater provide the wearer with the fashionable appearance of wearing a long sleeve shirt or blouse without the discomfort and problems associated with a long sleeve such as bulging and twisting of the shirt under the sweater. The cuffs include VELCRO® patches which enable the user to directly attach the cuffs to the sweater without relying on adapters and the like.

4 Claims, 1 Drawing Sheet

MINI-SHIRT

FIELD OF THE INVENTION

This invention relates to the art of wearing apparel generally and, more particularly, to a clothing ensemble which includes, in combination, a shirt dickey, a sweater and a pair of cuffs.

BACKGROUND OF THE INVENTION

Prior to the present invention, those who desired to wear a sweater over a long sleeve shirt to achieve the fashionable appearance such a combination provides, were faced with a plurality of problems.

The combination of a long sleeve shirt and sweater often causes the user to become too warm necessitating removal of the sweater often results in the user becoming too cold.

Moreover, the removal of the sweater often tends to cause the long sleeve shirt to become untucked. The user is often not aware of this such that others consider the user to be an unkempt person.

Additionally, the long sleeve shirt often bulges, twists or binds underneath the sweater creating discomfort as well as an untidy appearance.

SUMMARY OF THE INVENTION

The present invention includes a dickey and cuffs which are designed to be worn under a crew neck or V neck sweater. The cuffs add a finishing touch for a well dressed look for men, women and children. The utilization of the hooked components associated with VELCRO® material on the cuffs enables one to attach the cuffs directly in place on the inside of the sweater sleeve.

The present invention gives the illusion of the wearing of a long sleeve shirt, without the additional warmth rarely needed under a sweater.

By eliminating the need for long sleeves, the present invention eliminates annoying twisting and binding of the shirt at the shoulder and elbow areas.

By eliminating the body of the shirt, the excess bulk above the waist under the sweater is eliminated and provides a neater appearance.

The patches of material with hooked elements sold under the Trademark VELCRO are sewn to the cuffs and will secure the cuffs to the inside of the sweater sleeve. This will prevent movement of the cuffs within the sweater sleeve during any normal activity. Cuffs may be attached to the sweater sleeve at any desired exposed length or at the accepted standard of one-half inch beyond the sweater sleeve.

The present invention is convenient for travelers. It comprises about one-fifth the bulk of the conventional long sleeve shirt. It will also provide savings in cost compared to the conventional long sleeve shirt. Additional savings will be found in laundering cost and time.

The present invention would provide a savings for tall and large individuals. It would be manufactured by neck size, enabling tall and large individuals to wear it versus the more expensive tall and large shirts. Large people also have a tendency to be warm natured, the present invention would not provide the bulk or warmth of a full shirt.

The present invention herein disclosed will be easier to merchandise than a conventional shirt. The conventional shirt has two dimensions, the neck size and sleeve length. The present invention has only the neck size as a variable, thereby requiring less stock to be carried by a merchant to satisfy the needs of customers. Stock area will be greatly reduced versus a conventional line.

The dickey and cuffs of the present invention may be constructed of various types of fabric: oxford cloth, wash-and-wear, cotton or any shirt weight fabric. Depending to a great extent on the fabric and style of the dickey, the dickey can be in the form of a non-formal sport shirt, a formal dress shirt, as well as a blouse.

It is therefore the object of this invention to provide a novel shirt dickey with cuffs thereby providing the appearance of a long sleeve shirt.

It is still a further objective of this invention to provide a shirt dickey with cuffs which will be economical to manufacture and easy to merchandise.

It is a still further objective of this invention to provide a shirt dickey with cuffs which will be easily laundered and expediently ironed.

Further, the fuller objects will become readily apparent when reference is made to the accompanying drawings, wherein like reference characters indicate like parts.

DETAILED DESCRIPTION OF THE DRAWINGS

Figure 1:
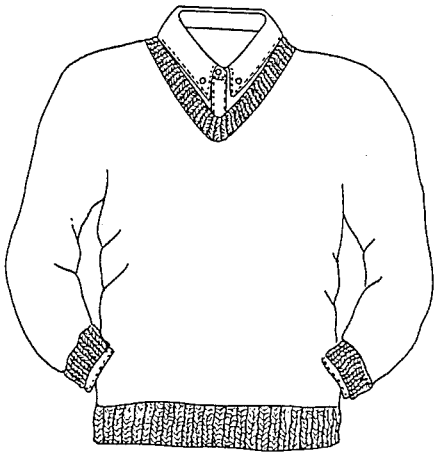
FIG. 1 is a view illustrating the dickey with cuffs worn with a sweater.
Figure 2:
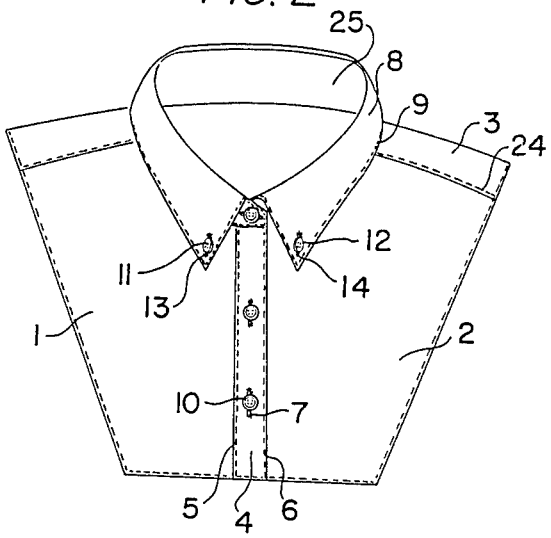
FIG. 2 is an elevational view of the front of the dickey.

In FIG. 2, the collar and the front of the dickey are illustrated in detail. It can be seen that the front panel 1 and 2 cover the wearer's chest and are attached at the shoulders to the back 3, thereby forming a neck opening. The shoulder seam may be top stitched 24. Front panels 1 and 2 are longer for women, to ensure front panels 1 and 2 lay flat and will not shift. Adjustable straps may be attached for women from panels 1 and 2 to back panel 3 or yoke 22 at a comfortable distance under the arms to also ensure front panels 1 and 2 do not shift.

A collar 8 is attached to the neck opening using conventional means with a facing 25. The collar is composed of a double thickness of fabric and top stitched 9 as shown for sport shirts. If the collar is a button down collar, as shown in FIG. 2, buttons 11 and 12 are sewn on front panels 1 and 2 which align with buttonholes 13 and 14 in the tip of the collar.

The front panels 1 and 2, depending on whether the dickey is for a man or a woman, or is a sport dress shirt, may have band portion 4 which is provided with parallel stitching 5 and 6 along the edges thereof. Buttonholes 7 are provided in the band 4 and collar facing 25 to receive buttons 10. The band 4 may be constructed with interfacing when necessary. Buttons 10 are placed on the front panel opposite the panel with band 4.

Figure 3:
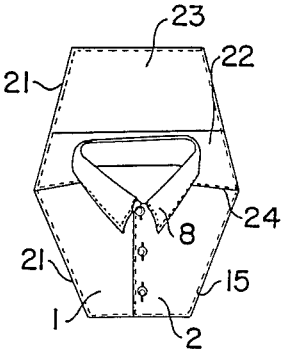
FIG. 3 is a schematic overall view of the dickey.

FIG. 3 illustrates how back panel 3 may be supplemented with a yoke 22 and smaller back panel 23. FIG. 3 also illustrates hem 15 around the entire dickey. Collar 8 and the front closure may be varied to construct a dress shirt by eliminating top stitching 5, 6, 9, 20 24 and band 4. Front panels 1 and 2 and back panels 3 and 23 are tapered along outside edge 21 to prevent excess fabric from buckling due to movement of the wearer.

Figure 4:
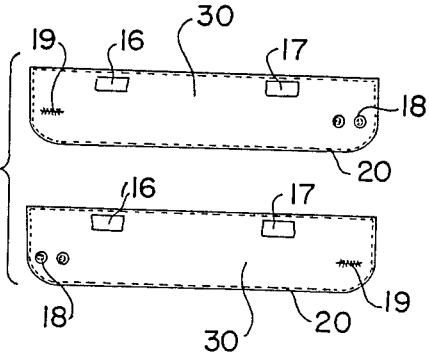
FIG. 4 is a schematic view of the cuffs.

FIG. 4 illustrates cuffs in detail with two patches of VELCRO ® material 16 and 17 attached and placed as shown. As shown in FIG. 4, two buttons 18 are placed on one end of the cuff and one buttonhole 19 is placed on the other end as illustrated. Cuffs 30 are constructed of double fabric with an interfacing. Cuffs are top stitched 20 along the edge as illustrated for a sport shirt.

Figure 5:
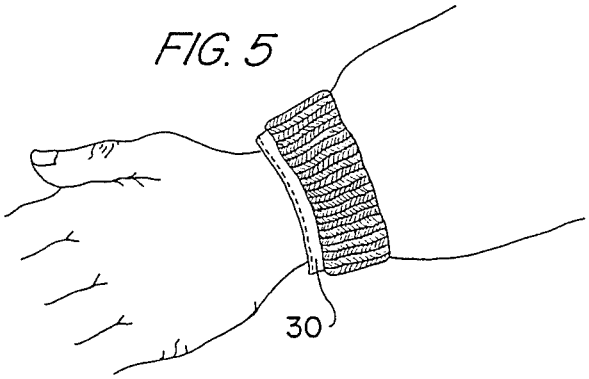
FIG. 5 is an illustration of how the cuff is worn.

FIG. 5 illustrates proper positioning of cuffs under the end of a sweater sleeve.

For ease of description, the principles of this invention have been set forth in connection with but a single illustration. It is not intended that the illustrated embodiment, nor the terminology employed in describing it, be limiting inasmuch as variations in these may be made without departing from the spirit of the invention. Rather, it is desired that the scope of the invention be restricted only by the appended claims.

We claim:

1. A clothing ensemble, comprising:

a sweater, said sweater formed of a material and having a pair of sleeves each including an inner surface;

a pair of cuffs with each cuff including attachment means for releasably attaching said cuffs directly to the material forming said sweater, said attachment means including a plurality of elongated elements having a first end in attachment with said cuff and a second hook-shaped end releasably connectable directly with the material forming said sweater, and said elongated elements being positioned between the inner surface of said sweater and said cuffs when said cuffs are in attachment with said sweater.

2. A clothing ensemble as recited in claim 1, wherein said attachment means includes a plurality of patches each having a plurality of said elongated elements extending therefrom and each affixed to said pair of cuffs.

3. A clothing ensemble as recited in claim 2, wherein each of said cuffs include a pair of said patches in spaced position adjacent an inner edge of said cuffs.

4. A clothing ensemble as recited in claim 1, further comprising a dickey which includes a yoke, a back panel secured to said yoke, a pair of front panels each having an upper edge attached to said yoke and each having an inside edge which overlaps with the inside edge of the other front panel, and each front panel having an outside edge which tapers continuously from the upper edge of said front panel to a lower edge of said front panel.

* * * * *